343-756 SR
8/26/80 OR 4,219,820

United States Patent [19]
Crail

[11] 4,219,820
[45] Aug. 26, 1980

[54] COUPLING COMPENSATION DEVICE FOR CIRCULARLY POLARIZED HORN ANTENNA ARRAY

[75] Inventor: Timothy A. Crail, Culver City, Calif.

[73] Assignee: Hughes Aircraft Company, Culver City, Calif.

[21] Appl. No.: 973,060

[22] Filed: Dec. 26, 1978

[51] Int. Cl.[2] ..... H01Q 15/24
[52] U.S. Cl. ..... 343/756; 343/909
[58] Field of Search ..... 343/756, 909, 776, 777, 343/778, 779

[56] References Cited

U.S. PATENT DOCUMENTS 3,560,984 2/1971 Lee et al. ..... 343/756
3,680,138 7/1972 Wheeler ..... 343/756
3,754,271 8/1973 Epis ..... 343/756

*Primary Examiner*—Eli Lieberman
*Attorney, Agent, or Firm*—John Holtrichter, Jr.; William H. MacAllister

[57] ABSTRACT

There are herein described microwave devices that are mounted at the output ends of circularly polarized horn antennas of a microwave antenna array. The devices act as coupling compensators between the horns, and also function as singular or dual polarization trimmers to create very low axial ratio circularly polarized antenna array patterns through a broad angular range. In each of these devices, a parasitic element is disposed on a planar substrate that is orthogonally positioned with respect to the direction of propagation from the horn antennas.

7 Claims, 6 Drawing Figures

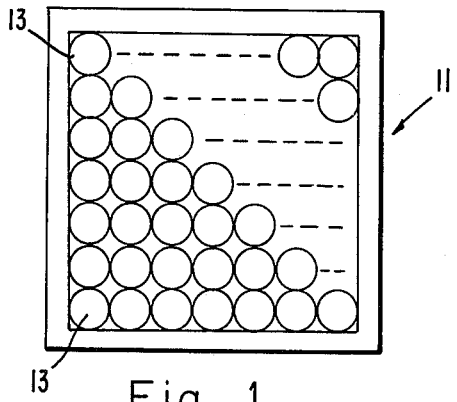
Fig. 1.
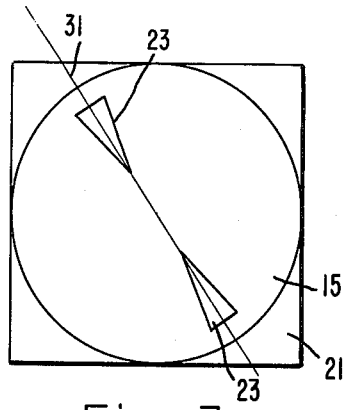
Fig. 3.
Fig. 2.
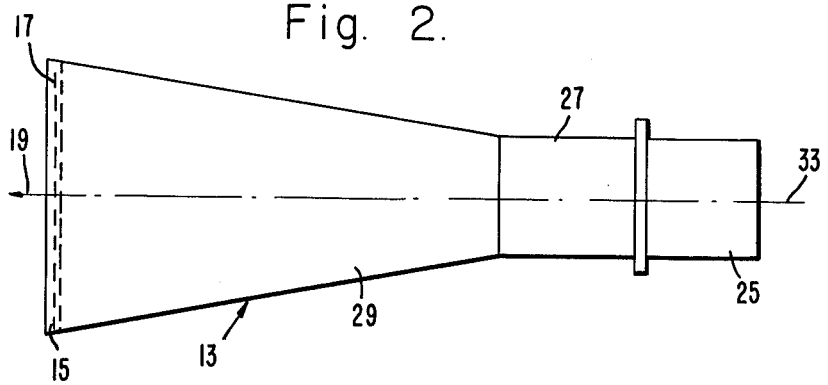
Fig. 6.
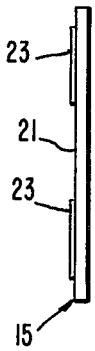
Fig. 5.
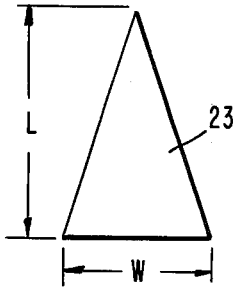
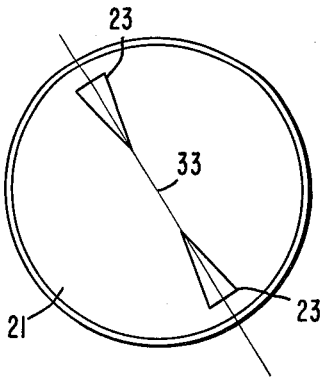
Fig. 4.

COUPLING COMPENSATION DEVICE FOR CIRCULARLY POLARIZED HORN ANTENNA ARRAY

BACKGROUND OF THE INVENTION

The background of the invention will be set forth in two parts.

1. Field of the Invention

This invention relates to microwave antennas and more particularly to circularly polarized microwave horn antennas used in antenna arrays.

2. Description of the Prior Art

In recent years there has been increased interest in microwave antenna systems and particularly in highly directional dual polarized microwave antenna arrays used in communication systems, for example. However, there is little known prior art designed for purification or reduction of axial ratio of circularly polarized horns which are arrayed in a multiple horn environment. It has been found that mutual coupling between the horns of an array significantly degrades the intrinsic polarization purity of the horns. As far as in known, existing techniques are generally applicable to a single polarization, i.e., fences, chokes, baffles, and the like, which are all polarization sensitive.

In contrast to the prior art, the invention utilizes the polarization characteristics of linear elements which act as coupling compensators between the horns of the antenna array and act as polarization trimmers to create very low cross polarization axial ratio, circularly polarized array patterns through a broad angular range.

SUMMARY OF THE INVENTION

In view of the foregoing factors and conditions characteristic of the prior art, it is a primary object of the present invention to provide a new and improved microwave device for improving circular polarization purity of an antenna array that includes a plurality of circularly polarized antenna horns.

Another object of the present invention is to provide a microwave device incorporating conductive elements adjacent the output end of circularly polarized horn antennas in an array enviroment to compensate for mutual coupling between the horn antennas.

Still another object of the present invention is to provide a microwave device for each circularly polarized horn antenna used in dual polarization microwave antenna arrays to act as polarization trimmers that produce very low cross polarization axial ratio.

In accordance with an embodiment of the present invention, a microwave device is provided in a microwave antenna array including a plurality of circularly polarized antenna horns and in which mutual coupling significantly degrades the intrinsic polarization purity of the horns, the device including a conductive element disposed on a planar substrate that is positioned at the output end of each of the circularly polarized antenna horns of a microwave antenna array in which mutual coupling significantly degrades the intrinsic polrization purity of the horns. The conductive elements provide coupling compensation between the horns to improve circular polarization purity of the antenna array.

The conductive elements may include a pair of spaced, diametrically opposed wedge-shaped elements each having length and width dimensions and a relatively thin depth or thickness dimension, where the apex of each of the pair of elements are disposed toward each other.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a block diagram of a microwave antenna array incorporating circularly polarized antenna horns utilizing microwave devices in accordance with the present invention.;

FIG. 2 is a side elevational view of one of the horn antennas of the array of FIG. 1;

FIG. 3 is a front elevational view of the output end of the horn antenna of FIG. 2, in accordance with one embodiment of the present invention;

FIG. 4 is a front elevational view of the output end of a horn antenna incorporating the microwave device of the invention in accordance with another embodiment of the invention;

FIG. 5 is an enlarged elevational view of one of the wedge-shaped conductive elements shown in FIGS. 3 and 4; and FIG. 6 is an enlarged side elevational view of the microwave device shown in FIG. 3.

DESCRIPTION OF THE PREFERRED EMBODIMENTS

Referring now to the drawings and more particularly to FIGS. 1–3, there is shown a microwave antenna array 11 including a plurality of circularly polarized antenna horns 13. Ordinarily, this type of array exhibits mutual coupling between the horns which significantly degrades the intrinsic polarization purity of the horns. However, in the array illustrated, a microwave device 15 is attached by any conventional means to the output end 17 of each of the horns 13 such that the plane of the device 15 is orthogonal to the direction of propagation from the horns, this direction generally being indicated by arrow 19.

As can best be seen in FIG. 3, the microwave device 15, in accordance with one embodiment of the invention, includes a planar substrate 21 such as a dielectric disk, a foam plastic disk, a polymide film, or a polystyrene disk, for example. The substrate 21 carries a pair of conductive elements 23 for providing coupling compensation between the horns in order to improve circuit polarization of the antenna array 11.

The horn antennas are otherwise conventional, and as seen in FIG. 2, include a orthogonal mode/feed input portion 25, a polarization section 27 for providing circularly polarized energy, and a horn section 29.

FIGS. 3 and 6 best illustrate the microwave device 15 in accordance with the embodiment of the invention wherein the horn section 29 has a rectangular cross section, while a similar device 15' for use with horn sections 29 that have a circular cross section, is shown in FIG. 4.

In either embodiment, the pair of conductive elements 23 are of and conductive material such as aluminum, silver, gold, for example, and are wedge-shaped and spaced from each other in diametrically opposed positions, where the apex of each of the elements is disposed toward the other element of the pair. Preferably, the elements 23 are symmetrically disposed along an axis line 31 that passes through the longitudinal axis 33 of the horn antenna 13.

The elements 23 may be prefabricated and attached by conventional bonding agents to the planar surface of the substrate 21, or they may be provided by deposition or etching techniques. These elements have a width dimension of approximately one-eigth free space wavelength of the RF energy radiated from the horn 13, and the length dimension is approximately one-quarter free space wavelength thereof.

Once the circularly polarized antenna horns 13 in the array 11 are fitted with the microwave devices 15, their optimum orientation to produce the desired coupling compensation is emperically determined by rotating the substrate 21 about the horn axis 33.

From the foregoing, it should be evident that there has herein been described a new and unobvious microwave device for providing coupling compensation between circularly polarized horn antennas of a microwave antenna array which would otherwise exhibit mutual coupling to significantly degrade the intrinsic polarization purity of the horn antennas.

It should further be understood that materials exhibiting similar desired characteristics to those herein described may be utilized, and that various changes and modifications obvious to persons skilled in the art to which the invention pertains are deemed to lie within the spirit, scope and contemplation of the invention.

What is claimed is:

1. In a microwave antenna array including a plurality of circularly polarized antenna horns and in which mutual coupling significantly degrades the intrinsic polarization purity of the horns, a microwave device comprising:

a planar substrate disposed at the output end of said horns orthogonal to the direction of propagation from said horns; and conductive element means disposed on each of said planar substrates for providing coupling compensation between said horns to improve circular polarization purity of said antenna array, said conductive element means including a pair of spaced and diametrically opposed wedge-shaped elements having length and width dimensions and relatively thin depth dimension, the apex of each of said pair of elements being disposed toward each other.

2. The microwave device according to claim 1, wherein said substrate is a dialectric disk and said elements are metallic structures.

3. The microwave device according to claim 2, wherein said dielectric disk is a polymide film.

4. The microwave device according to claim 1, wherein said substrate is a foam plastic disk and said elements are metallic structures.

5. The microwave device according to claim 4, wherein said foam plastic disk is a polystyrene disk.

6. The microwave device according to claim 1, wherein each of said elements has a width dimension of approximately one-eigth free space wavelength of the radio frequency energy propagating from the antenna horns, and has a length dimension of approximately one-quarter free space wavelength thereof.

7. The microwave device according to claim 1, wherein each of said planar substrates is rotationally orientatable to produce a maximum value of said coupling compensation.

* * * * *